US008627807B2

(12) United States Patent
Wikström

(10) Patent No.: US 8,627,807 B2
(45) Date of Patent: Jan. 14, 2014

(54) ARRANGEMENT FOR COOLING OF RECIRCULATED EXHAUST GASES IN A COMBUSTION ENGINE

(75) Inventor: Hans Wikström, Johanneshov (SE)

(73) Assignee: Scania CV AB (SE)

( * ) Notice: Subject to any disclaimer, the term of this patent is extended or adjusted under 35 U.S.C. 154(b) by 462 days.

(21) Appl. No.: 13/125,830

(22) PCT Filed: Oct. 21, 2009

(86) PCT No.: PCT/SE2009/051196

§ 371 (c)(1),
(2), (4) Date: Apr. 25, 2011

(87) PCT Pub. No.: WO2010/053429

PCT Pub. Date: May 14, 2010

(65) Prior Publication Data

US 2011/0239996 A1 Oct. 6, 2011

(30) Foreign Application Priority Data

Nov. 5, 2008 (SE) ..... 0802349

(51) Int. Cl.
*F02M 25/07* (2006.01)

(52) U.S. Cl.
USPC ..... 123/568.12

(58) Field of Classification Search
USPC ..... 123/568.12, 41.31
See application file for complete search history.

(56) References Cited

U.S. PATENT DOCUMENTS 5,607,010 A 3/1997 Schonfeld et al.
7,617,679 B2 * 11/2009 Kardos et al. ..... 60/605.2
8,028,523 B2 * 10/2011 Wikstrom et al. ..... 60/605.2
8,413,627 B2 * 4/2013 Kardos et al. ..... 123/142.5 E (Continued)

FOREIGN PATENT DOCUMENTS

JP 2003-214262 A 7/2003
WO WO 2007/074264 A1 7/2007

OTHER PUBLICATIONS

International Search Report dated Feb. 22, 2010, issued in corresponding international application No. PCT/SE2009/051196.

*Primary Examiner* — Thomas Moulis
(74) *Attorney, Agent, or Firm* — Ostrolenk Faber LLP

(57) ABSTRACT

An arrangement for recirculation of exhaust gases of a combustion engine (2) in a vehicle (1), including an exhaust line (4) to lead exhaust gases out from the combustion engine (2), and a return line (5) for recirculating part of the exhaust gases in the exhaust line (4) to the combustion engine (2). A high-temperature cooling system (11) containing a circulating coolant in the form of a liquid medium which, at an intended operating pressure in the high-temperature cooling system (11), has a boiling point of at least 150° C. An EGR cooler (10) subjects the recirculating exhaust gases in the return line (5) to a first step of cooling by the circulating high-temperature coolant. A radiator element (13) cools the high-temperature coolant by air. There is a second cooler cooled by engine coolant which cools gases in the return line. There is an optional third low-temperature cooling system and a further cooler in the third system cooling gases in the return line.

7 Claims, 2 Drawing Sheets

(56) References Cited

U.S. PATENT DOCUMENTS

| | | | | |
|---|---|---|---|---|
| 8,424,303 | B2 * | 4/2013 | Kardos et al. | 60/599 |
| 8,490,392 | B2 * | 7/2013 | Kardos et al. | 60/599 |
| 8,511,260 | B2 * | 8/2013 | Kardos et al. | 123/41.33 |
| 2004/0194917 | A1 | 10/2004 | Usui | |
| 2005/0188965 | A1 | 9/2005 | Usui | |
| 2008/0053090 | A1 * | 3/2008 | Kardos et al. | 60/605.2 |
| 2008/0256949 | A1 | 10/2008 | Wikstrom et al. | |
| 2010/0006043 | A1 * | 1/2010 | Kardos et al. | 123/41.01 |
| 2011/0139131 | A1 * | 6/2011 | Kardos et al. | 123/542 |
| 2011/0315130 | A1 * | 12/2011 | Kardos et al. | 123/568.12 |
| 2013/0167784 | A1 * | 7/2013 | Quix et al. | 123/41.1 |

* cited by examiner

ARRANGEMENT FOR COOLING OF RECIRCULATED EXHAUST GASES IN A COMBUSTION ENGINE

CROSS-REFERENCE TO RELATED APPLICATIONS

The present application is a 35 U.S.C. §§371 national phase conversion of PCT/SE2009/051196, filed Oct. 21, 2009, which claims priority of Swedish Application No. 0802349-1, filed Nov. 5, 2008, the contents of which are incorporated by reference herein. The PCT International Application was published in the English language.

BACKGROUND TO THE INVENTION, AND STATE OF THE ART

The present invention relates to an arrangement for cooling of recirculating exhaust gases of a combustion engine.

The technique called EGR (exhaust gas recirculation) is a known way of recirculating part of the exhaust gases in an exhaust line of a combustion engine. The exhaust gases are led through a return line and mixed with inlet air to the combustion engine before the mixture is led to the cylinders of the combustion engine. Adding exhaust gases to the air causes a lower combustion temperature resulting inter alia in a reduced content of nitrogen oxides $NO_x$ in the exhaust gases. This technique is used both for Otto engines and for diesel engines.

The amount of exhaust gases which can be supplied to a combustion engine depends on the pressure and temperature of the exhaust gases. Supplying as large an amount of exhaust gases to the combustion engine as possible entails effective cooling of the exhaust gases before they are led to the combustion engine. A known practice is to cool the recirculating exhaust gases in one or more EGR coolers before they are led to the combustion engine. The recirculating exhaust gases may in that case undergo a first step of cooling in an EGR cooler which is cooled by coolant from the combustion engine's cooling system and a second step of cooling in an EGR cooler which is cooled by coolant from a low-temperature cooling system. The exhaust gases may thus be cooled to a temperature close to the temperature of the surroundings.

During operation of the combustion engine, the exhaust gases will be at a temperature ranging from 150° C. to 600° C. The temperature of the recirculating exhaust gases will be highest when the combustion engine is under great load. In cases where the combustion engine's cooling system is used for cooling the recirculating exhaust gases, the cooling system will thus be subject to high load peaks at times when the combustion engine is under great load. In heavy vehicles, the combustion engine's cooling system is commonly also used for other cooling requirements in the vehicle, e.g. cooling the oil of a hydraulic retarder. It is therefore desirable to reduce the load on the combustion engine's cooling system.

SUMMARY OF THE INVENTION

The object of the present invention is to provide an arrangement whereby effective cooling of recirculating exhaust gases of a combustion engine can be achieved in a first step.

The invention uses a high-temperature cooling system with a circulating coolant which has a significantly higher boiling point than the coolant which circulates in a conventional cooling system for cooling a combustion engine. The high-temperature cooling system comprises an EGR cooler in which the exhaust gases in the return line are cooled by the circulating coolant, and a radiator element in which the coolant is cooled by air. One way of raising the boiling point of a coolant in a cooling system is to raise the pressure in the cooling system. An easier way is to use a cooling medium which has a clearly higher boiling point than water. The recirculating exhaust gases may be at a temperature of up to 600° C. The coolant in the high-temperature cooling system has therefore to have a relatively high boiling point so that it is not vaporised when it cools the exhaust gases in the EGR cooler. The coolant in the high-temperature cooling system therefore needs a boiling point of at least 150° C. and preferably a boiling point above 300° C. Heat transfer liquids with a high boiling point are commercially available. Such liquids are usually oils of various kinds. An example of such a heat transfer liquid is XCELTHERM®, which has a boiling point of 400° C. at atmospheric pressure. Such a heat transfer liquid with a suitable boiling point may with advantage be used in the high-temperature cooling system for cooling the recirculating exhaust gases in the EGR cooler. As the recirculating exhaust gases are at such a high temperature, they undergo good cooling even by a coolant which is at a relatively high temperature. The coolant in the high-temperature cooling system may for example be at a temperature of about 150° C. when it is led into the EGR cooler. Such a high-temperature cooling system makes it possible to achieve effective cooling of the recirculating exhaust gases in a first step.

According to a preferred embodiment of the present invention, the radiator element of the high-temperature cooling system is situated in a region which is intended to have air flowing through it, at a location downstream of a radiator element of a cooling system which is adapted to cooling the combustion engine. The coolant in the combustion engine's cooling system is normally cooled in a radiator element situated in a region at a front portion of the vehicle, in which case the radiator element of the high-temperature cooling system will therefore be situated at the front portion behind the radiator element of the combustion engine's cooling system. The radiator element of the high-temperature cooling system will thus have air flowing through it which has already passed through, and been warmed in, the radiator element of the combustion engine's cooling system. As the coolant in the high-temperature cooling system will be at a higher temperature than the coolant in the combustion engine's cooling system, this relatively warm air can still provide effective cooling of the coolant in the high-temperature cooling system. With advantage, the radiator element of the high-temperature cooling system is situated at a location between the radiator element of the combustion engine's cooling system and a radiator fan which is adapted to generating a cooling air flow through the radiator elements. Such positioning of the radiator element of the high-temperature cooling system results in an ample air flow through it which cools the coolant in the high-temperature cooling system. In this case it is thus possible to use an already existing air flow for cooling the coolant in the high-temperature cooling system.

According to another embodiment of the invention, the high-temperature cooling system comprises a separate radiator fan situated close to the radiator element and adapted to generating a cooling air flow through the radiator element. Such a separate radiator fan makes it possible to fit the radiator element of the high-temperature cooling system at substantially any desired location in the vehicle. With advantage, the radiator element of the high-temperature cooling system is situated in an internal region of the vehicle, close to the combustion engine. The lines of the high-temperature cooling system in which the coolant circulates may therefore be relatively short. The radiator element of the high-temperature cooling system may be fastened to the combustion engine, in which case the lines which circulate the coolant in the high-temperature cooling system may be very short. The radiator element of the high-temperature cooling system may in this case be directly or indirectly fastened to the combustion engine by suitable fastening elements.

According to another preferred embodiment of the invention, the arrangement comprises at least a further EGR cooler for subjecting the recirculating exhaust gases to at least a further step of cooling before they are led to the combustion engine. The high-temperature cooling system, which has a coolant at a relatively high temperature, does not usually manage to cool the recirculating exhaust gases to a desired low temperature. The recirculating exhaust gases therefore need cooling further before they are led to the combustion engine. The recirculating exhaust gases may be intended to be cooled in a further EGR cooler by the coolant from the combustion engine's cooling system. During normal operation, the coolant in the combustion engine's cooling system will be at a temperature of 80-100° C. The coolant in the combustion engine's cooling system will be at a lower temperature than the coolant in the high-temperature cooling system. It is therefore possible to use the coolant in the combustion engine's cooling system for subjecting the recirculating exhaust gases to a second step of cooling. As the recirculating exhaust gases will have already undergone a first step of cooling by the high-temperature cooling system, the result in this case is a relatively moderate load on the combustion engine's cooling system. The recirculating exhaust gases will with advantage be subjected to a third step of cooling to achieve a desired low temperature. To this end, the recirculating exhaust gases may be cooled in a further EGR cooler by coolant from a low-temperature cooling system in which the coolant is intended to be at a lower temperature than the coolant in the combustion engine's cooling system. This low-temperature cooling system comprises with advantage a radiator element in which the coolant in the cooling system is cooled by air at the temperature of the surroundings. The coolant in the low-temperature cooling system may thus assume a temperature close to the temperature of the surroundings. Cooling of the exhaust gases to a desired low temperature is thus made possible. Alternatively, the exhaust gases may be subjected to this step of cooling by an air-cooled EGR cooler, in which case the recirculating exhaust gases will with advantage be cooled by air at the temperature of the surroundings.

BRIEF DESCRIPTION OF THE DRAWINGS

Preferred embodiments of the invention are described below by way of examples with reference to the attached drawings, in which.

DETAILED DESCRIPTION OF PREFERRED EMBODIMENTS OF THE INVENTION

Figure 1:
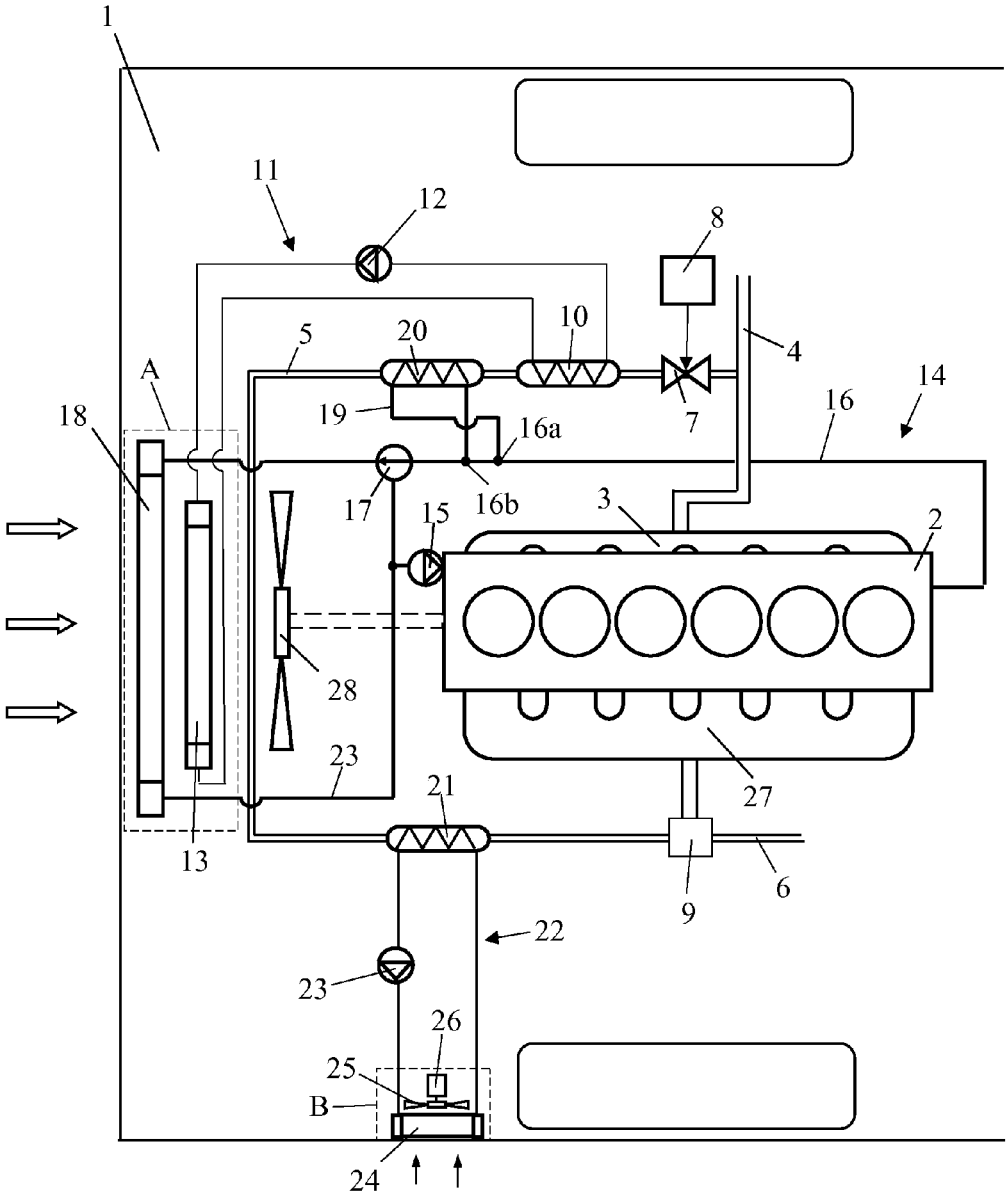
FIG. 1 depicts an arrangement for a supercharged diesel engine according to a first embodiment of the invention and FIG. 2 depicts an arrangement for a supercharged diesel engine according to a second embodiment of the invention.

FIG. 1 depicts an arrangement for a combustion engine 2 which is adapted to powering a schematically depicted vehicle 1. The combustion engine is here exemplified as a diesel engine 2. The diesel engine 2 may be intended to power a heavy vehicle 1. The exhaust gases from the cylinders of the diesel engine 2 are led to an exhaust line 4 via an exhaust manifold 3. The arrangement comprises a return line 5 for effecting recirculation of part of the exhaust gases in the exhaust line 4. The return line 5 has an extent between the exhaust line 4 and an inlet line 6 for compressed air to the combustion engine 2. The diesel engine 2 is thus in this case supercharged. The return line 5 comprises an EGR valve 7 by which the exhaust flow in the return line 5 can be shut off. The EGR valve 7 may also be used for steplessly controlling the amount of exhaust gases which is led to the combustion engine 2. A control unit 8 is adapted to controlling the EGR valve 7 on the basis of information about the current operating state of the diesel engine 2. The recirculating exhaust gases from the return line 5 are mixed with the compressed air in the inlet line 6 by means of a mixing device 9. In certain operating states of supercharged diesel engines 2, the pressure of the exhaust gases in the exhaust line 4 will be lower than the pressure of the compressed air in the inlet line 6. In such operating situations it is not possible to mix the exhaust gases in the return line 5 directly with the compressed air in the inlet line 6 without special auxiliary means. To this end it is possible to use, for example, a turbo unit with variable geometry. If instead the combustion engine 2 is a supercharged Otto engine, the exhaust gases in the return line 5 can be led directly into the inlet line 6, since the exhaust gases in the exhaust line 4 of an Otto engine will in substantially all operating situations be at a higher pressure than the compressed air in the inlet line 6.

The arrangement comprises a high-temperature cooling system 11 with a circulating coolant in the form of a cooling medium which will have at an intended operating pressure in the cooling system a boiling point of at least 150° C. The high-temperature cooling system 11 comprises an EGR cooler 10 in which the recirculating exhaust gases in the return line 5 are intended to be subjected to a first step of cooling. The recirculating exhaust gases led into the EGR cooler 10 may be at a temperature of up to 600° C. The coolant in the high-temperature cooling system needs to have such a high boiling point that there is no risk of its beginning to vaporise in the cooling system when it cools the recirculating exhaust gases in the EGR cooler 10. A coolant with a boiling point above 300° C. may be used in this case. The coolant in the high-pressure system 11 may be an oil which has good heat transfer characteristics. A coolant pump 12 circulates the coolant in the high-temperature cooling system 11. The high-temperature cooling system 11 comprises a radiator element 13 for cooling the coolant. The radiator element 13 is situated in a region A of the vehicle 1 in which it has a cooling air flow passing through it during operation of the combustion engine 2.

The combustion engine 2 is cooled in a conventional manner by a cooling system 14 which contains a circulating coolant. A coolant pump 15 circulates the coolant in the combustion engine's cooling system 14. After the coolant has circulated through the combustion engine 2, it is led in a line 16 to a thermostat 17. In situations where the coolant has reached a normal operating temperature, the thermostat 17 is adapted to leading the coolant to a radiator element 18 fitted in the region A at a location in front of the radiator element 13 in the high-temperature cooling system 11. A radiator fan 28 is adapted to generating a cooling air flow through the radiator elements 13, 18 during operation of the combustion engine 2. Part of the coolant in the line 16 is led into a line circuit 19 at a location 16*a* of the line 16. The coolant which is led into the line circuit 19 is led through a second EGR cooler 20 in which the coolant subjects the recirculating exhaust gases in the return line 5 to a second step of cooling. The coolant is thereafter led back to the line 16 at a location 16*b* situated downstream of the location 16*a* with respect to the intended direction of coolant flow in the line 16.

The recirculating exhaust gases proceed in the return line 5 to a third EGR cooler 21 in which they are subjected to a third step of cooling by the coolant in a low-temperature cooling system 22. The low-temperature cooling system 22 contains a circulating coolant which is at a lower temperature than the coolant in the combustion engine's cooling system 14. A coolant pump 23 circulates the coolant in the low-temperature cooling system 22. The low-temperature cooling system 22 comprises a radiator element 24 situated in a peripheral region B of the vehicle 1. A separate radiator fan 25 driven by an electric motor 26 provides a cooling air flow through the radiator element 24 in the region B. After the cooling in the three EGR coolers 10, 20, 21, the recirculating exhaust gases are led to the mixing device 9, in which they are mixed with the compressed air in the inlet line 6. Thereafter the mixture of air and exhaust gases is led to the respective cylinders of the diesel engine 2 via a manifold 27.

During operation of the diesel engine 2, exhaust gases flow out from the combustion engine 2 and into the exhaust line 4. During most operating states of the diesel engine 2, the control unit 8 keeps the EGR valve 7 open so that part of the exhaust gases in the exhaust line 4 is led into the return line 5. The exhaust gases led into the return line 5 will usually be at a temperature within the range 150° C.-600° C., depending on the operating state of the combustion engine. The recirculating exhaust gases in the return line 5 are subjected to a first step of cooling in the EGR cooler 10 by the coolant in the high-temperature cooling system 11. The coolant in the high-temperature cooling system 11 gives off heat in a radiator element 13 which is therefore situated in the region A at a location downstream of the radiator element 18 in the combustion engine's cooling system 14 with respect to the direction of air flow in the region A. The coolant in the radiator element 13 is thus cooled by air at a higher temperature than the coolant in the radiator element 18. The air passing through the radiator element 18 usually undergoes a temperature rise of 20° C.-40° C. It will therefore not be possible for the coolant in the high-temperature cooling system to be cooled to the same low temperature as the coolant in the combustion engine's cooling system 14. It is however possible for the coolant in the high-temperature cooling system 11 to be cooled to a low enough temperature to be able to apply a first step of effective cooling to the recirculating exhaust gases. The recirculating exhaust gases may for example be at a temperature within the range 150° C.-200° C. when they leave the EGR cooler 10. The recirculating exhaust gases are thereafter led to the EGR cooler 20, in which they are cooled by coolant from the combustion engine's cooling system 14. The coolant here will normally be at a temperature within the range 80° C.-100° C. The recirculating exhaust gases may therefore be cooled to a temperature of about 100° C.-120° C. in the EGR cooler 20. The recirculating exhaust gases are led finally to the EGR cooler 21, in which they are subjected to the third step of cooling by coolant from the low-temperature cooling system 22. The radiator element 24 in the low-temperature cooling system 22 is cooled by air at the temperature of the surroundings which is forced through the radiator element 24 by a separate radiator fan 25. The coolant in the low-temperature cooling system may thus be cooled to a temperature close to the temperature of the surroundings. The recirculating exhaust gases may therefore undergo the third step of cooling to a relatively low temperature in the EGR cooler 21 before they are mixed with the compressed air, which will with advantage have been cooled to a similar temperature in an undepicted charge air cooler, before the mixture is led to the combustion engine 2.

In operating situations where the combustion engine 2 is under great load, it needs good cooling. The exhaust gases will also be at a high temperature in such situations. However, the initial cooling of the recirculating exhaust gases by the high-temperature cooling system 11 reduces their temperature substantially before they are subjected to the second step of cooling by the combustion engine's cooling system 14. The load on the combustion engine's cooling system 14 is thus substantially reduced. Locating the radiator element 13 of the high-temperature cooling system 11 in the region A means that the already existing cooling air flow in the region A can also be used for cooling the coolant in the high-temperature cooling system 11.

Figure 2:
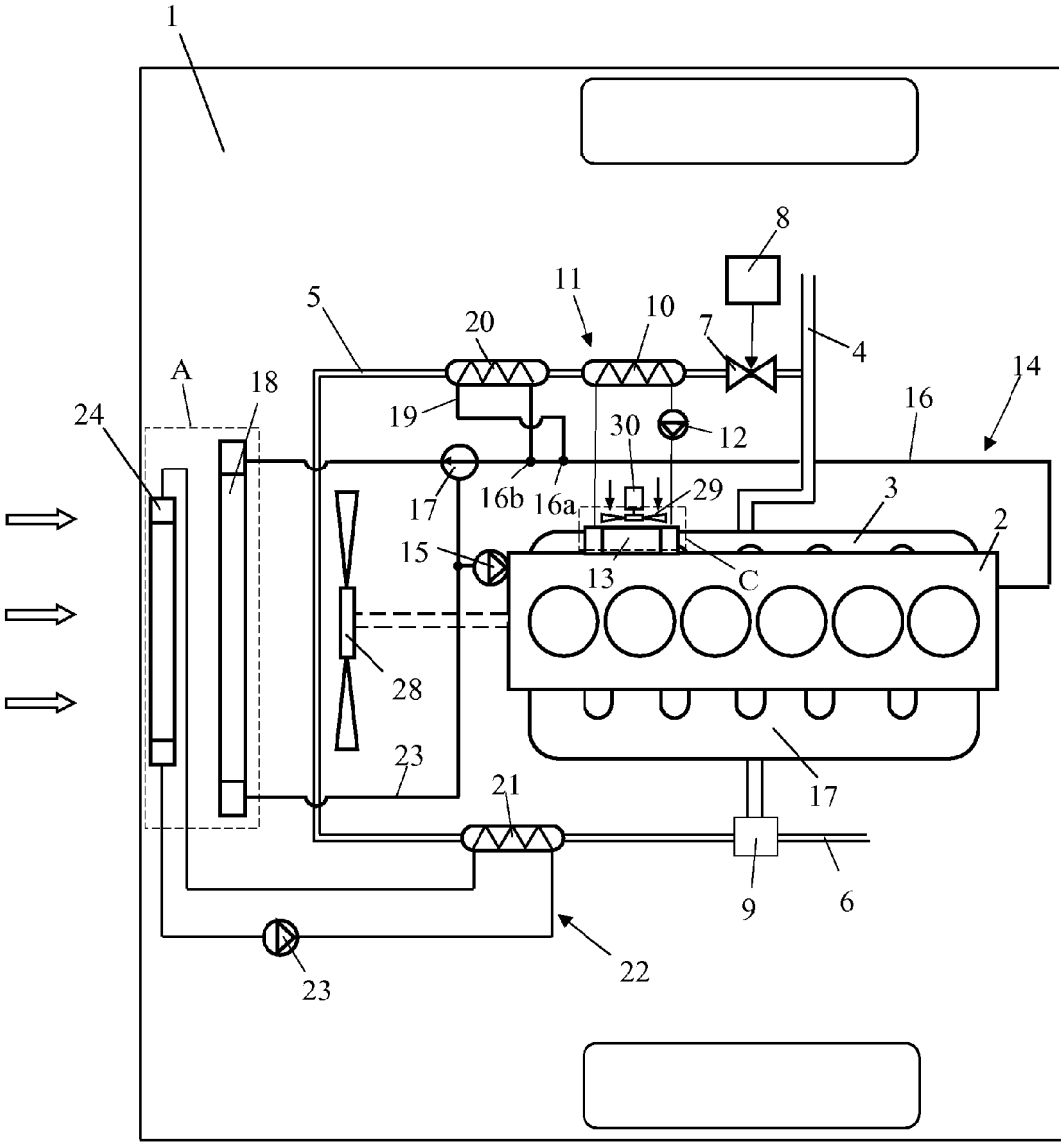

FIG. 2 depicts an alternative embodiment of the arrangement. In this case the radiator element 13 of the high-temperature cooling system 11 is situated in an internal region C of the vehicle. The radiator element 13 is here fastened to the combustion engine 2 by suitable fastening elements. A separate fan 29 driven by an electric motor 30 is adapted to generating a cooling air flow through the radiator element 13. The air in the vicinity of the combustion engine 2 will be relatively warm but still usable with advantage for cooling the coolant in the high-temperature cooling system 11. In this case the lines for the circulating coolant may be very short, since the distance between the EGR cooler 10 and the radiator element 13 is short. In this case the radiator element 24 in the low-temperature cooling system 22 is situated in the region A at a location upstream of the radiator element 18 of the combustion engine's cooling system 14. The coolant in the low-temperature cooling system 22 will here too be cooled by air at the temperature of the surroundings. In this case the air which cools the coolant in the radiator element 18 will be at a somewhat raised temperature. As the coolant in the combustion engine's cooling system is nominally at a temperature of about 80° C., this is not immediately a disadvantage. In this embodiment of the arrangement, the recirculating exhaust gases undergo three steps of cooling in a manner substantially similar to the embodiment in FIG. 1. We therefore give no further description of the cooling of the recirculating exhaust gases in this case. In this embodiment too, the presence of the high-temperature cooling system 11 results in reduced load on the combustion engine's cooling system 14.

The invention is in no way limited to the embodiment to which the drawing refers but may be varied freely within the scopes of the claims. The recirculating exhaust gases need not necessarily be subjected to three steps of cooling, as it is also possible that they may undergo fewer steps of cooling.

The invention claimed is:

1. An arrangement for recirculation of exhaust gases of a combustion engine in a vehicle, the arrangement comprising an exhaust line for leading exhaust gases out from the combustion engine;

a return line connected to the exhaust line for recirculating exhaust gases in the exhaust line to the combustion engine a high-temperature cooling system containing a first high temperature circulating coolant in the form of a liquid medium; an EGR cooler in the high temperature cooling system and configured for being cooled by the first coolant, the EGR cooler being at the return line for subjecting the recirculating exhaust gases in the return line to a first step of cooling by the circulating first high-temperature coolant;

a first radiator element in the high temperature cooling system and positioned in a region of the vehicle for air to flow through the first radiator element, the first high temperature coolant passes through the first radiator element so that the high-temperature coolant is cooled by air passing the first radiator element, the liquid medium of the first high temperature coolant, at an intended operating pressure in the high-temperature cooling system has a boiling point above 300° C.;

a second cooling system for cooling the engine;

a second radiator element in the second cooling system and positioned in a region of the vehicle for having air flow through the second radiator element;

the first radiator element being downstream in air flow through the radiator elements from the second radiator element, such that air passing the second radiator element is warmed before the air passes the first radiator element.

2. An arrangement according to claim 1, further comprising a radiator fan;

the first radiator element of the high-temperature cooling system is situated in a location between the second radiator element of the combustion engine's cooling system and the radiator fan, and the radiator fan is configured and located for generating the air flow through the radiator elements.

3. An arrangement according to claim 1, further comprising a further EGR cooler being located at the return line and being configured and operable for subjecting the recirculating exhaust gases in the return line to at least a further step of cooling before the exhaust gases are led in the return line to the combustion engine.

4. An arrangement according to claim 3, wherein the engine has an engine cooling system circulating a second coolant, the further EGR cooler being in the engine cooling system and being configured to be cooled by the second coolant, so that the recirculating exhaust gases are cooled in the further EGR cooler by coolant from the combustion engine's cooling system.

5. An arrangement according to claim 4, further comprising another EGR cooler located at the return line after the EGR cooler and the further EGR cooler for cooling recirculating exhaust gases, a low-temperature cooling system circulating a third coolant which is at a lower temperature than the second coolant in the combustion engine cooling system the other EGR cooler being in the low temperature cooling system.

6. An arrangement according to claim 5, further comprising a second radiator element in the low temperature cooling system such that the third coolant in the low-temperature cooling system is cooled in the second radiator element by air at the temperature of the surroundings of the second radiator element.

7. An arrangement according to claim 4, further comprising a second radiator element in the engine cooling system for cooling the second coolant.

* * * * *